US007743656B1

(12) United States Patent
Dickinson et al.

(10) Patent No.: US 7,743,656 B1
(45) Date of Patent: Jun. 29, 2010

(54) SYSTEM AND METHOD FOR MEASURING FLEXIBILITY

(75) Inventors: Elisabeth Dickinson, Vancouver (CA); Manson Fei, Vancouver (CA)

(73) Assignee: Physi-Cal Enterprises Ltd., Vancouver, BC (CA)

( * ) Notice: Subject to any disclaimer, the term of this patent is extended or adjusted under 35 U.S.C. 154(b) by 30 days.

(21) Appl. No.: 12/337,616

(22) Filed: Dec. 17, 2008

Related U.S. Application Data

(60) Provisional application No. 61/015,190, filed on Dec. 19, 2007.

(51) Int. Cl.
*A63B 21/00* (2006.01)

(52) U.S. Cl. ..... 73/379.01

(58) Field of Classification Search . 73/379.01–379.05; 482/91, 192, 18
See application file for complete search history.

(56) References Cited

U.S. PATENT DOCUMENTS 5,163,443 A * 11/1992 Fry-Welch et al. ..... 600/595
6,149,550 A * 11/2000 Shteingold ..... 482/8
6,322,483 B1 * 11/2001 Rotella ..... 482/129
6,487,906 B1 * 12/2002 Hock ..... 73/379.01
6,612,170 B2 * 9/2003 Brown ..... 73/379.06
6,639,162 B2 * 10/2003 Sandbach et al. ..... 200/512
6,662,651 B1 * 12/2003 Roth ..... 73/379.02
7,331,226 B2 * 2/2008 Feldman et al. ..... 73/379.01
7,438,674 B2 * 10/2008 Sjodin, Torbjorn ..... 482/91

* cited by examiner

*Primary Examiner*—Jewel Thompson
(74) *Attorney, Agent, or Firm*—Clause Eight IPS; Michael Cantania; Elaine H. Lo

(57) ABSTRACT

An apparatus, method and system for measuring an individual's flexibility are disclosed herein. The apparatus includes a first flexible fabric strap portion, a flexible e-textile fabric portion, a monitoring device and a second flexible fabric strap portion connected to a second end of the monitoring device. The system further includes a communication device for receiving a signal from the apparatus and a computing device for processing the signal from the apparatus.

19 Claims, 4 Drawing Sheets

SYSTEM AND METHOD FOR MEASURING FLEXIBILITY

CROSS REFERENCE TO RELATED APPLICATION

The Present Application claims priority to U.S. Provisional Patent Application No. 61/015,190, filed on Dec. 19, 2007, which is hereby incorporated by reference in its entirety.

STATEMENT REGARDING FEDERALLY SPONSORED RESEARCH OR DEVELOPMENT

Not Applicable

BACKGROUND OF THE INVENTION

1. Field of the Invention

The present invention relates to exercise equipment. More specifically, the present invention relates to exercise equipment with strength monitoring capabilities.

2. Description of the Related Art

Exercise is important to everyone, and there are many reasons that people exercise. For enjoyment, good health, to maintain an attractive physique, to be stronger, to excel at a particular sport, and many other numerous reasons. However, no matter what the reason is for exercising, there is usually a desire to track one's exercise performance. Tracking one's performance can be as simple as monitoring the time it takes to run a mile to quantify the time improvement. Or tracking one's ability to lift a larger mass when working with weights.

In our high technology society, the ability to use technology to monitor one's exercise performance is becoming an essential requirement for any physical activity. Most stationary exercise equipment now provides numerous information to the user such as calories burned, heart rate, distance achieved, and much more. Other physical activities have similar technological devices for providing performance monitoring. However, one physical activity area has been ignored, stretching and stretching-like physical activities such as yoga, pilates, and the like.

What is needed is a tool that can measure the flexibility of an individual in a particular area and predict an optimal stretch capability for that individual. The same tool could be used to increase the individual's flexibility.

BRIEF SUMMARY OF THE INVENTION

The present invention provides a unique solution to the need for measuring one's performance during a stretching exercise. Further, the present invention provides a system for monitoring one's stretching capability and for developing an optimal stretching capability.

One aspect of the present invention is an apparatus for measuring an individual's flexibility. The apparatus preferably includes a first flexible fabric strap portion, a flexible e-textile portion, a monitoring device, and a second flexible fabric portion. The flexible e-textile fabric portion preferably has a first end and a second end, with the first end of the flexible e-textile fabric portion preferably connected to the flexible fabric strap portion. However, the flexible e-textile portion can be any structure and may only be a strand interconnected into a flexible fabric strap portion. The monitoring device preferably has a first end and a second end. The monitoring device preferably includes a microprocessor, a display member, a plurality of control buttons, and means for wireless communication. The first end of the monitoring device is preferably connected to the second end of the flexible e-textile fabric portion wherein the flexible e-textile fabric portion is preferably in electrical communication with the microprocessor. The second flexible fabric strap portion is preferably connected to the second end of the monitoring device.

Another aspect of the present invention is a system for measuring an individual's flexibility. The system preferably includes an apparatus for measuring an individual's flexibility and range of motion, a communication device and a computing device. The apparatus preferably includes a wireless transceiver for transmitting a signal for a flexibility value for the individual. The communication device preferably receives the signal from the apparatus. The computing device preferably processes the signal from the apparatus.

Yet another aspect of the present invention is a method for measuring an individual's flexibility. The method preferably includes stretching an apparatus having means for measuring an individual's flexibility. The method also preferably includes transmitting an electrical transmission through the flexible e-textile fabric portion. The method also preferably includes measuring the resistance of the electrical transmission through the flexible e-textile fabric portion to generate a resistance value. The measure also preferably includes converting the resistance value into a flexibility value with the microprocessor. The method also preferably includes displaying the flexibility value on the display member.

Yet another aspect of the present invention is a method for measuring an individual's flexibility and strength as determined by the force of the individual pulling on a strap and the change in the elasticity.

Yet another aspect of the present invention is a system for measuring an individual's flexibility and strength. The system preferably includes an apparatus for measuring an individual's flexibility, strength and range of motion, and a watch device configured to operate on a 2.4 gighertz communication protocol to receive the individual's flexibility, strength and range of motion values and to display such values on the watch. The apparatus preferably includes a wireless transceiver for transmitting a signal to the watch.

Yet another aspect of the present invention is a system for measuring an individual's flexibility and strength. The system preferably includes an apparatus for measuring an individual's flexibility, strength and range of motion, a communication device configured to operate on a 2.4 gighertz communication protocol to receive the individual's flexibility, strength and range of motion values, and a web portal. The apparatus preferably includes a wireless transceiver for transmitting a signal to the communication device. The communication device is preferably capable of transferring the signal information from the apparatus over a network to the web portal for health management of the individual.

Having briefly described the present invention, the above and further objects, features and advantages thereof will be recognized by those skilled in the pertinent art from the following detailed description of the invention when taken in conjunction with the accompanying drawings.

DETAILED DESCRIPTION OF THE INVENTION

Figure 1:
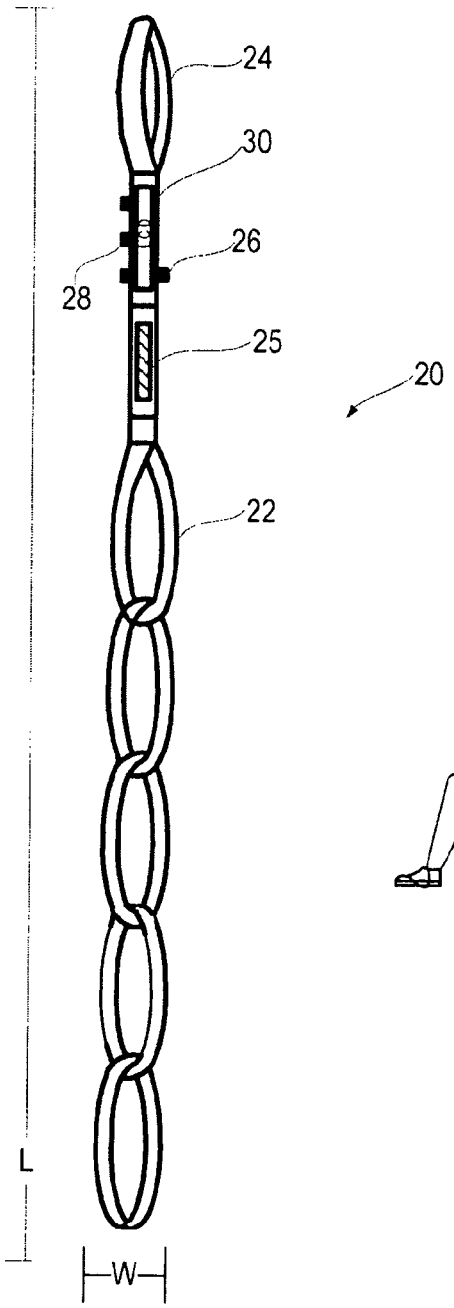
FIG. 1 is a perspective view of the apparatus of the present invention.
Figure 2:
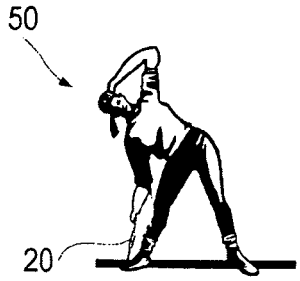
FIG. 2 is an image of an individual stretching with the apparatus.
Figure 3:
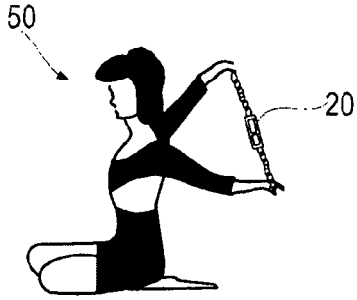
FIG. 3 is an image of an individual stretching with the apparatus.
Figure 4:
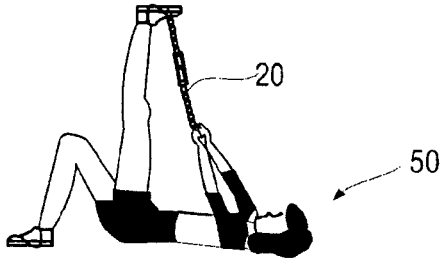
FIG. 4 is an image of an individual stretching with the apparatus.
Figure 5:
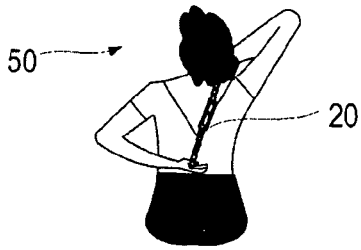
FIG. 5 is an image of an individual stretching with the apparatus.

As shown in FIG. 1, an apparatus for measuring an individual's flexibility is generally designated 20. The apparatus 20 preferably includes a first flexible fabric strap portion 22, a second flexible fabric strap portion 24, a flexible e-textile fabric portion 25 and a monitoring device 26. The monitoring device 26 has a plurality of control buttons 28, a display member 30 and a microprocessor 32. The apparatus 20 has a length, L, preferably ranging from 1 meter to 3 meters, more preferably from 1.5 meters to 2.5 meters, and most preferably 2 meters. The apparatus 20 has a width, W, preferably ranging from 1 centimeter to 5 centimeters, more preferably from 2 centimeters to 4 centimeters and most preferably 3 centimeters. The apparatus 20 has a thickness, T, preferably ranging from 0.1 centimeter to 1.0 centimeter.

As shown in FIGS. 2-5, individuals 50 stretch the apparatus 20 using various parts of their bodies. Preferably, the apparatus 20 is configured to allow for measuring the flexibility of different body parts of the individual, including the following: back, external obliques, neck, forearms, wrists, triceps, chest, buttocks, adductors, quadriceps, calves, shins, hamstrings and instep.

The first flexible fabric strap portion 22 and second flexible fabric strap portion 24 are preferably composed of an elastic material such as a nylon material.

The flexible e-textile fabric portion 25 is preferably composed of a textile fabric with a nano-layer of a conductive material. Currently, flexible e-textile fabrics are being developed that utilize nanotechnology and fabrics. The Hong Kong Polytechnic University is developing textile fabrics with a nano-layer of conducting material deposited on the surface of the textile fabrics. A method for forming such textile fabrics is disclosed in Tao et al., United States Patent Publication Number 20070065586 for Methods For Coating Conducting Polymer which is hereby incorporated by reference in its entirety. Other fabrics are being developed by the Hong Kong Research Institute Of Textiles And Apparel. The conductivity (resistance) of the textile fabric changes with the deformation (stretching) of textile fabric. The flexible e-textile fabric portion 25 may only be a single strand integrated into a flexible fabric strap portion. However, the flexible e-textile fabric portion 25 can be various structures without departing from the scope and spirit of the present invention.

Figure 8:
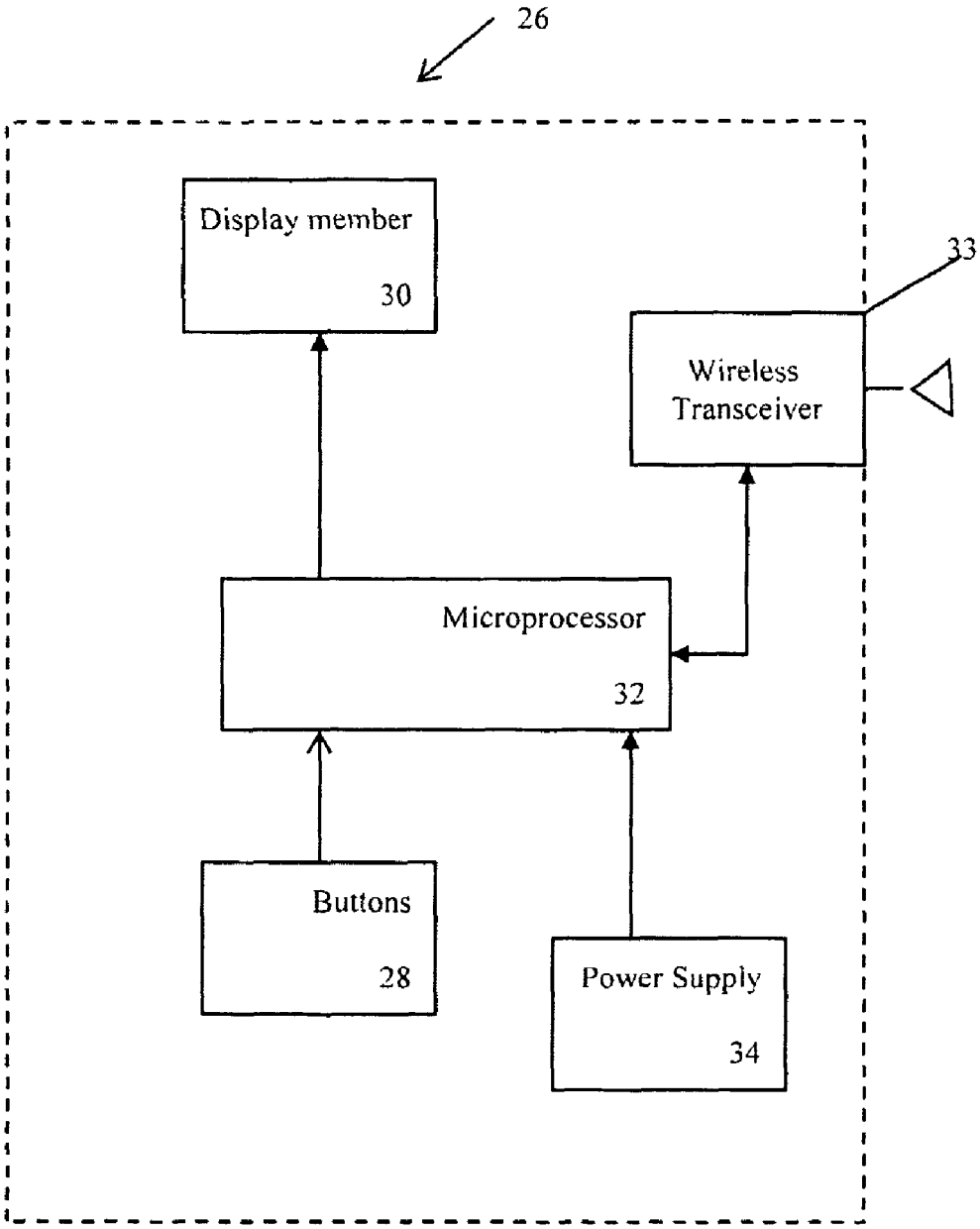
FIG. 8 is a schematic of the monitoring device of the present invention.

The monitoring device 26 is shown in FIG. 8. The monitoring device 26 preferably includes a microprocessor 32, a wireless transceiver 33, a display member 30, a power supply 34 and a plurality of control buttons. The microprocessor 32 is preferably in electrical communication with the flexible e-textile fabric portion 25.

Alternatively, the apparatus 50', not shown, is a legging that is utilized in orthopedic therapy. The legging is pulled over the calf, knee and thigh of the individual. The individual begins at the fully extended position. The leg of the individual is bent, and the angle of the bend is measured using the apparatus.

Figure 6:
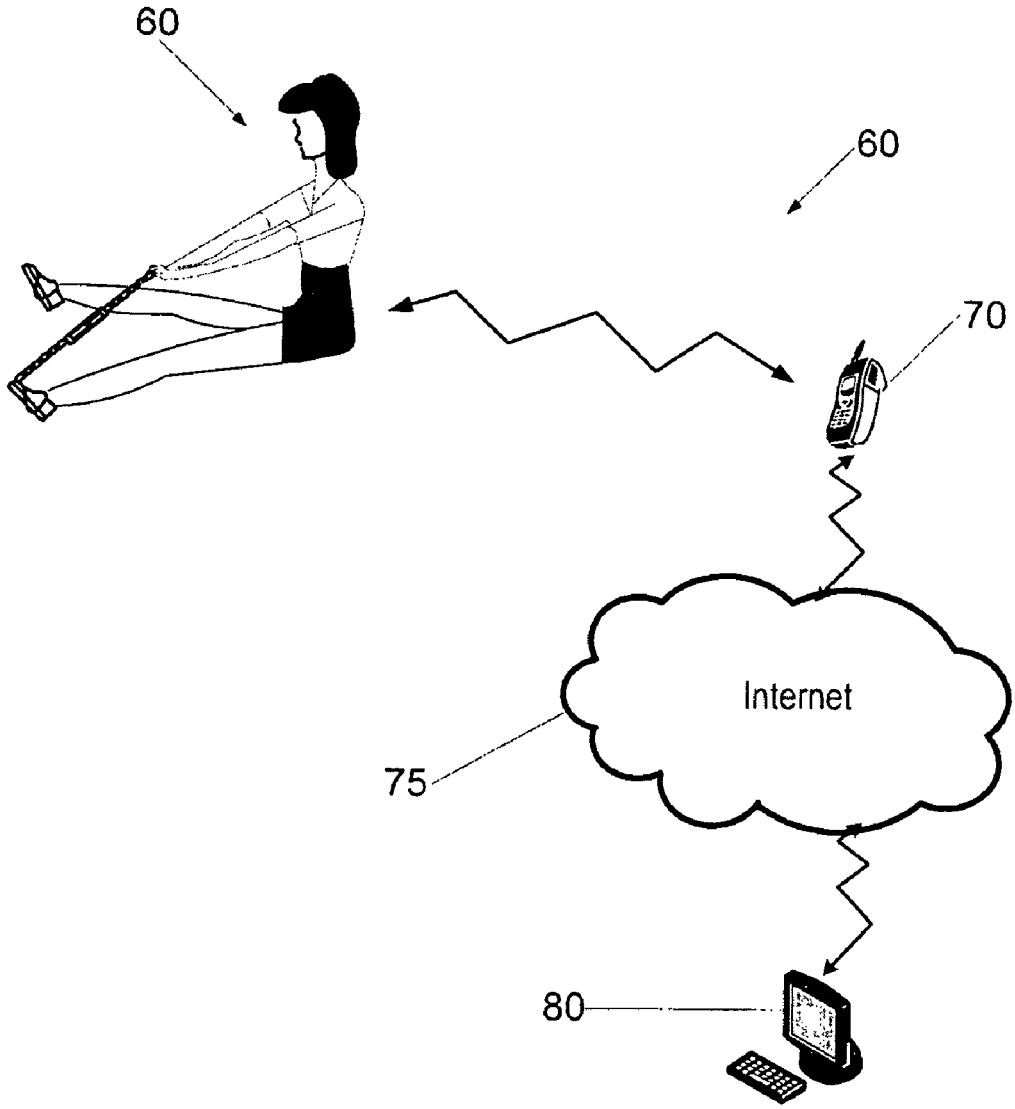
FIG. 6 is a schematic diagram of the system of the present invention.

A system 60 of the present invention is shown in FIG. 6. An individual 50 stretches the apparatus 20. The microprocessor 32 of the monitoring device 26 measures the flexibility of the individual 50 and the wireless transceiver 33 transmits a signal to a communication device 70, which is preferably a PDA or mobile telephone. The communication device 70 transmits the signal over the Internet 75 to a computing device 80 preferably located at a remote location. In a preferred embodiment, the computing device 80 is accessed through a website using a typical HTTP protocol. The system 60 is utilized to determine an optimal and target stretch capability for the individual 50.

In an alternative system, the individual stretches the apparatus 20 using different muscles and reads the flexibility value for each stretch. The individual 50 then accesses a website and enters the individual's flexibility values in a table such as shown in Table One. The individual 50 also enters additional information such as age, weight, height, sex, and the like. The computing device 80 processes the information to provide optimal flexibility values for the individual 50.

TABLE ONE

| Muscle | Flexibility Value (1-100) | Optimal/Target Flexibility Value |
|---|---|---|
| Back | 25 | 25 |
| External Obliques | 50 | 60 |
| Neck | 20 | 40 |
| Forearms | 55 | 75 |
| Wrists | 10 | 25 |
| Triceps | 25 | 30 |
| Chest | 30 | 30 |
| Buttocks | 40 | 45 |
| Adductors | 25 | 25 |
| Quadriceps | 30 | 50 |
| Calves | 55 | 60 |
| Shins | 40 | 40 |
| Hamstrings | 60 | 70 |
| Instep | 50 | 50 |

Figure 7:
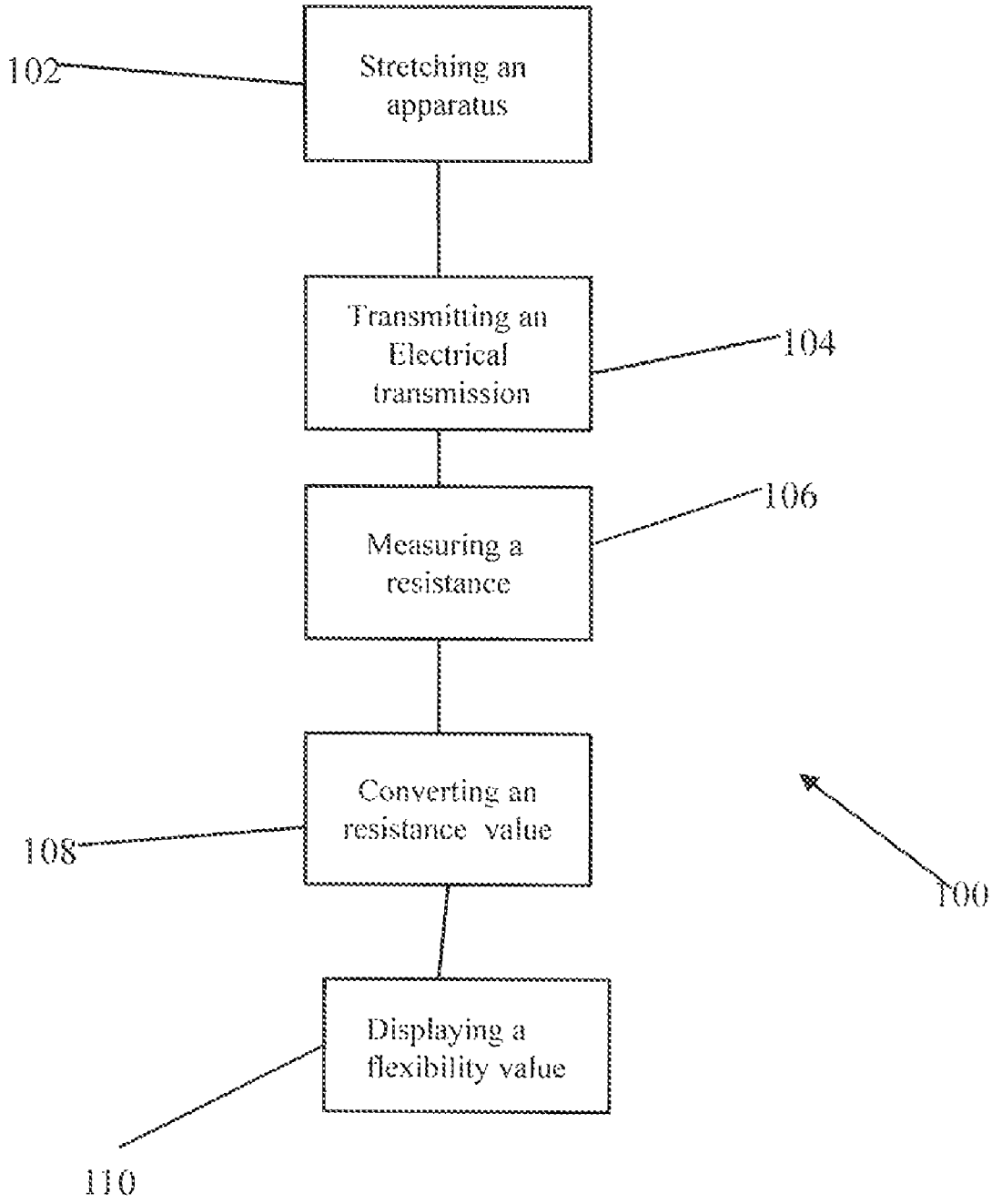
FIG. 7 is a flow chart of method of the present invention.

A method 100 of the present invention is shown in FIG. 7. At block 102, an individual stretches the apparatus 20. At block 104, an electrical transmission is sent through the flexible e-textile fabric portion 25. At block 106, a resistance is measured for the flexible e-textile fabric portion 25. At block 108, the resistance value for the flexible e-textile fabric portion 25 is converted into a flexibility value. At block 110, the flexibility value is displayed on the display member 30 for viewing by the individual.

From the foregoing it is believed that those skilled in the pertinent art will recognize the meritorious advancement of this invention and will readily understand that while the present invention has been described in association with a preferred embodiment thereof, and other embodiments illustrated in the accompanying drawings, numerous changes modification and substitutions of equivalents may be made therein without departing from the spirit and scope of this invention which is intended to be unlimited by the foregoing except as may appear in the following appended claim. Therefore, the embodiments of the invention in which an exclusive property or privilege is claimed are defined in the following appended claims.

We claim as our invention:

1. An apparatus for measuring an individual's flexibility, the apparatus comprising:

a first flexible fabric strap portion;

a flexible e-textile fabric portion the flexible e-textile fabric portion connected to the flexible fabric strap portion; and a monitoring device having a first end and a second end, the monitoring device comprising a microprocessor, a display member, a plurality of control buttons, and means for wireless communication, the first end of the monitoring device connected to the flexible e-textile fabric portion wherein the flexible e-textile fabric portion is in electrical communication with the microprocessor.

2. The apparatus according to claim 1 wherein the apparatus further comprises a second flexible fabric strap portion connected to the monitoring device.

3. The apparatus according to claim 2 wherein the first flexible fabric portion and the second flexible fabric portion are composed of a nylon material.

4. The apparatus according to claim 1 wherein the display member is a liquid crystal display.

5. The apparatus according to claim 1 wherein the wireless communication means is a BLUETOOTH device.

6. The apparatus according to claim 1 wherein the apparatus has a width, W, ranging from 1 centimeter to 5 centimeters, and a length, L, ranging from 1 meter to 3 meters.

7. The apparatus according to claim 1 flexible e-textile fabric portion has a length, Le, ranging from 1 centimeter to 10 centimeters.

8. The apparatus according to claim 1 flexible e-textile fabric portion has a width, We, ranging from 1 centimeter to 5 centimeters and a thickness ranging from 0.1 centimeter to 1.0 centimeter.

9. The apparatus according to claim 1 wherein the apparatus is a legging.

10. A system for measuring an individual's flexibility, the system comprising:

an apparatus for measuring an individual's flexibility and range of motion, the apparatus comprising a first flexible fabric strap portion, a flexible e-textile fabric portion having a first end and a second end, a first end of the flexible e-textile fabric portion connected to the flexible fabric strap portion, a monitoring device having a first end and a second end, the monitoring device comprising a microprocessor, a display member, and a plurality of control buttons, the first end of the monitoring device connected to the second end of the flexible e-textile fabric portion wherein the flexible e-textile fabric portion is in electrical communication with the microprocessor, a second flexible fabric strap portion connected to the second end of the monitoring device, and a wireless transceiver for transmitting a signal, the signal comprising a flexibility value for the individual;

a communication device for receiving the signal from the apparatus; and a computing device for processing the signal from the apparatus.

11. The system according to claim 10 wherein the communication device and the computing device are integrated as a single machine.

12. The system according to claim 10 further comprising a network and wherein the communication device communicates with the computing device over the network.

13. The system according to claim 12 wherein the network is the Internet.

14. The system according to claim 13 wherein computing device is accessible through a website using a HTTP protocol.

15. The system according to claim 10 wherein the communication device is a PDA or mobile telephone.

16. The system according to claim 10 wherein the flexible e-textile fabric portion is composed of a textile fabric substrate and a nanolayer of a conductive material.

17. The system according to claim 10 wherein the apparatus has a length, L, ranging from 1 meter to 3 meters and a thickness ranging from 0.1 centimeter to 1.0 centimeter.

18. The system according to claim 10 wherein the communication device is a watch configured to utilize a 2.4 gighertz communication protocol for receiving the signal from the apparatus, the watch comprising a display member for displaying the flexibility value, the strength value and the range of motion for the individual.

19. A method for measuring an individual's flexibility, the method comprising:

stretching an apparatus, the apparatus comprising a first flexible fabric strap portion, a flexible e-textile fabric portion having a first end and a second end, a first end of the flexible e-textile fabric portion connected to the flexible fabric strap portion, a monitoring device having a first end and a second end, the monitoring device comprising a microprocessor, a display member, and a plurality of control buttons, the first end of the monitoring device connected to the second end of the flexible e-textile fabric portion wherein the flexible e-textile fabric portion is in electrical communication with the microprocessor, and a second flexible fabric strap portion connected to the second end of the monitoring device;

transmitting an electrical transmission through the flexible e-textile fabric portion;

measuring the resistance of the electrical transmission through the flexible e-textile fabric portion to generate a resistance value;

converting the resistance value into a flexibility value with the microprocessor; and displaying the flexibility value on the display member.

* * * * *